US009970249B2

(12) United States Patent
Zhang et al.

(10) Patent No.: US 9,970,249 B2
(45) Date of Patent: May 15, 2018

(54) DEGRADABLE ANCHOR DEVICE WITH GRANULAR MATERIAL

(71) Applicants: Zhihui Zhang, Katy, TX (US); YingQing Xu, Tomball, TX (US); Zhiyue Xu, Cypress, TX (US); James King, Kingwood, TX (US)

(72) Inventors: Zhihui Zhang, Katy, TX (US); YingQing Xu, Tomball, TX (US); Zhiyue Xu, Cypress, TX (US); James King, Kingwood, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 677 days.

(21) Appl. No.: 14/561,523

(22) Filed: Dec. 5, 2014

(65) Prior Publication Data

US 2016/0160592 A1 Jun. 9, 2016

(51) Int. Cl.
*E21B 23/01* (2006.01)
*E21B 23/06* (2006.01)

(52) U.S. Cl.
CPC ..... *E21B 23/01* (2013.01); *E21B 23/06* (2013.01)

(58) Field of Classification Search
CPC ..... E21B 23/01; E21B 23/06
See application file for complete search history.

(56) References Cited

U.S. PATENT DOCUMENTS 8,403,037 B2 3/2013 Agrawal et al.
8,584,746 B2 11/2013 Marya et al.
2002/0121160 A1* 9/2002 Bangert ..... E21B 19/07 81/57.5
2007/0107908 A1 5/2007 Vaidya et al.
2010/0206550 A1* 8/2010 Barlow ..... E21B 33/129 166/118
2010/0276159 A1* 11/2010 Mailand ..... E21B 33/134 166/382
2010/0294510 A1 11/2010 Holmes
2011/0067889 A1* 3/2011 Marya ..... E21B 33/134 166/386
2011/0132620 A1 6/2011 Agrawal et al.
2012/0073834 A1 3/2012 Lembcke
2012/0273229 A1 11/2012 Xu et al.
2012/0292053 A1 11/2012 Xu et al.
(Continued)

OTHER PUBLICATIONS

PCT International Search Report and Written Opinion; International Application No. PCT/US2016/034581; International Filing Date: May 27, 2016; dated Sep. 2, 2016; pp. 1-15.

*Primary Examiner* — Robert E Fuller
*Assistant Examiner* — David Carroll
(74) *Attorney, Agent, or Firm* — Cantor Colburn LLP

(57) ABSTRACT

In one aspect, an anchoring device is disclosed, including: a degradable substrate with a first hardness; and a granular gripping material associated with the outer extent of the degradable substrate, wherein the granular gripping material has a second hardness greater than the first hardness. In certain embodiments, the granular gripping material is degradable. In another aspect, a method to anchor a downhole device is disclosed, including: providing a degradable substrate with a first hardness; and applying a granular gripping material to the outer extent of the degradable substrate, wherein the granular gripping material has a second hardness greater than the first hardness.

19 Claims, 2 Drawing Sheets

(56) References Cited

U.S. PATENT DOCUMENTS

| | | | | |
|---|---|---|---|---|
| 2013/0048305 | A1 | 2/2013 | Xu et al. | |
| 2013/0118759 | A1 | 5/2013 | Crews | |
| 2013/0299192 | A1* | 11/2013 | Xu | E21B 23/01 166/382 |
| 2013/0327545 | A1* | 12/2013 | Marya | E21B 33/129 166/382 |
| 2014/0014339 | A1* | 1/2014 | O'Malley | E21B 43/261 166/281 |
| 2014/0027127 | A1* | 1/2014 | Frazier | E21B 33/00 166/376 |
| 2014/0190685 | A1* | 7/2014 | Frazier | E21B 33/1208 166/250.01 |
| 2014/0190705 | A1 | 7/2014 | Fripp et al. | |
| 2015/0129239 | A1* | 5/2015 | Richard | E21B 23/06 166/377 |
| 2015/0247376 | A1* | 9/2015 | Tolman | E21B 33/12 166/297 |
| 2016/0160592 | A1 | 6/2016 | Zhang et al. | |

* cited by examiner

DEGRADABLE ANCHOR DEVICE WITH GRANULAR MATERIAL

BACKGROUND

Field of the Disclosure

This disclosure relates generally to degradable slip rings and systems that utilize same for downhole applications.

Background of the Art

Wellbores are drilled in subsurface formations for the production of hydrocarbons (oil and gas). Hydrocarbons are trapped in various traps or zones in the subsurface formations at different depths. In many operations, such as fracturing, it is required to anchor devices (such as packers, bridge plugs, etc.) in a downhole location to facilitate production of oil and gas. After such operations, anchoring devices must be removed or destroyed before following operations can begin. Such removal operations may be costly and/or time consuming. It is desired to provide an anchoring device that can provide sufficient anchoring performance while providing desired and predictable degradation characteristics.

The disclosure herein provides controlled degradable slip rings and systems using the same for downhole applications.

SUMMARY

In one aspect, an anchoring device is disclosed, including: a degradable substrate with a first hardness; and a granular gripping material associated with the outer extent of the degradable substrate, wherein the granular gripping material has a second hardness greater than the first hardness.

In another aspect, a method to anchor a downhole device is disclosed, including: providing a degradable substrate with a first hardness; and applying a granular gripping material to the outer extent of the degradable substrate, wherein the granular gripping material has a second hardness greater than the first hardness.

In another aspect, a downhole system is disclosed, including: a casing string; and an anchoring device associated with the casing string, including: a degradable substrate with a first hardness; and a granular gripping material associated with the outer extent of the degradable substrate, wherein the granular gripping material has a second hardness greater than the first hardness and the second hardness is greater than a hardness of an inner diameter of the casing string.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures, wherein like numerals have generally been assigned to like elements and in which.

DESCRIPTION OF THE EMBODIMENTS

Figure 1:
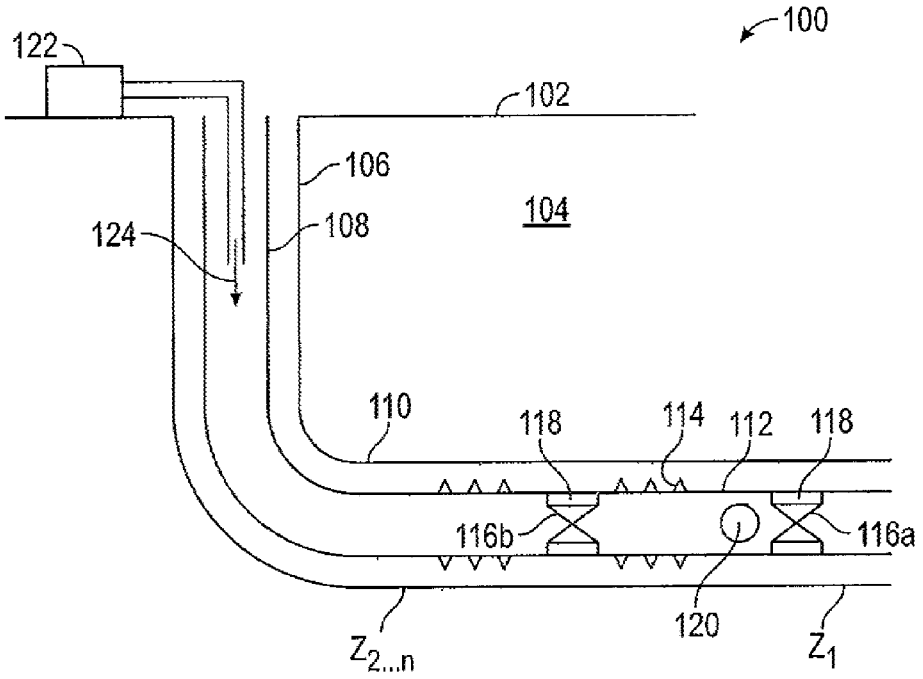
FIG. 1 is a schematic diagram of an exemplary drilling system that includes downhole elements according to embodiments of the disclosure.

FIG. 1 shows an exemplary embodiment of a downhole system to facilitate the production of oil and gas. In certain embodiments, system 100 allows for fracturing operations to facilitate production of oil and gas. System 100 includes a wellbore 106 formed in formation 104 with casing 108 disposed therein.

In an exemplary embodiment, a wellbore 106 is drilled from a surface 102 to a downhole location 110. Casing 108 may be disposed within wellbore 106 to facilitate production. In an exemplary embodiment, casing 108 is disposed through multiple zones of production Z1 . . . Zn in a downhole location 110. Wellbore 106 may be a vertical wellbore, a horizontal wellbore, a deviated wellbore or any other suitable type of wellbore or any combination thereof.

To facilitate downhole operations, such as fracturing operations, bridge plugs 116*a*, packers 116*b*, or other suitable downhole devices are utilized within casing string 108. In certain embodiments, such downhole devices 116*a,b* are anchored to casing string 108 via an anchor assembly 118. In certain embodiments, bridge plugs 116*a* utilize an anchor assembly 118 and frac balls 120 to isolate zones Z1 . . . Zn for fracturing operations. In certain embodiments, frac balls 120 are disposed at a downhole location 110 to obstruct and seal fluid flow in local zone 112 to facilitate flow to perforations 114 in conjunction with frac plugs 116*a*. In certain embodiments, packers 116*b* are utilized in conjunction with anchor assembly 118 to isolate zones Z1 . . . Zn for fracturing operations.

In certain embodiments, frac fluid 124 is pumped from a frac fluid source 122 to a downhole location 110 to flow through perforations 114 in a zone 112 isolated by downhole device 116*a,b*. Advantageously, fracturing operations allow for more oil and gas available for production.

After desired operations (such as fracturing operations) and before following operations, anchoring devices 118 are often removed or otherwise destroyed to allow the flow of oil and gas through casing 108. In an exemplary embodiment, anchoring devices 118 are configured to anchor against casing 108 of local zone 112 until a predetermined time at which anchoring devices 118 dissolve or degrade to facilitate the production of oil and gas. Advantageously, in an exemplary embodiment, the anchoring devices 118 herein are formed of multiple materials to have predictable and adjustable degradation characteristics while allowing for suitable anchoring characteristics.

Figure 2:
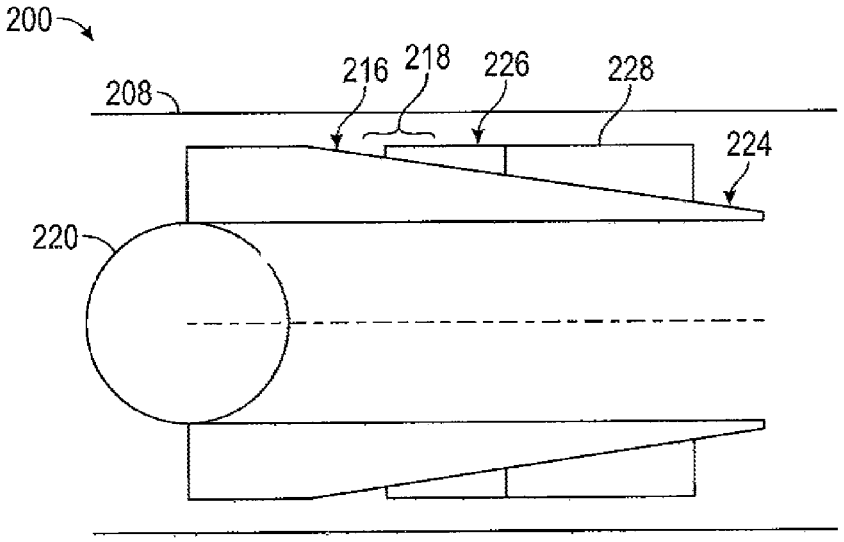
FIG. 2 is a schematic diagram of an exemplary downhole device for use in a downhole system, such as the one shown in FIG. 1, according to one embodiment of the disclosure.

FIG. 2 shows a downhole device 216, such as a bridge plug, packer, or any other suitable downhole device, for use downhole systems such as the system 100 shown in FIG. 1. In an exemplary embodiment, downhole system 200 includes downhole device 216 interfacing with casing 208 via anchor assembly 218 to anchor a downhole device 216. In certain embodiments, a frac ball 220 is used with downhole device 216 to isolate frac fluid flow within the wellbore.

In an exemplary embodiment, anchor assembly 218 includes a wedge 224 and a slip ring 228. In certain embodiments, wedge 224 is forced downhole to force slip ring 228 outward against casing 208 to anchor against casing 208. In certain embodiments, slip ring 228 can crack or otherwise separate as it is driven against casing 208. In certain embodiments, wedge 224 is forced via a setting tool, explosives, or any other suitable means. In certain embodiments, downhole device 216 further utilizes a sealing member 226 to seal downhole device 216 against casing 208 and further resist movement. Sealing member 226 may similarly be driven toward casing 208 via wedge 224.

In an exemplary embodiment, a substrate of a slip ring 228 is formed of a degradable material to allow slip ring 228 to dissolve or degrade after a desired anchoring function is performed. In certain embodiments, a secondary material is used in conjunction with the substrate of the slip ring 228 to anchor the slip ring 228 against casing 208. Typically, a secondary material is harder than casing 208 to allow slip ring 228 to partially embed in casing 208. In certain embodiments, the downhole temperature exposure to downhole device 216 and slip ring 228 varies from 100 to 350 degrees Fahrenheit at a particular downhole location for a given area. Advantageously, slip ring 228 as described herein may allow for degradation after a desired time in certain downhole environments, while allowing suitable anchoring performance. In certain embodiments, portions of slip ring 228 can degrade or otherwise not prevent further downhole operations or restrict flow within a wellbore.

Figure 3A:
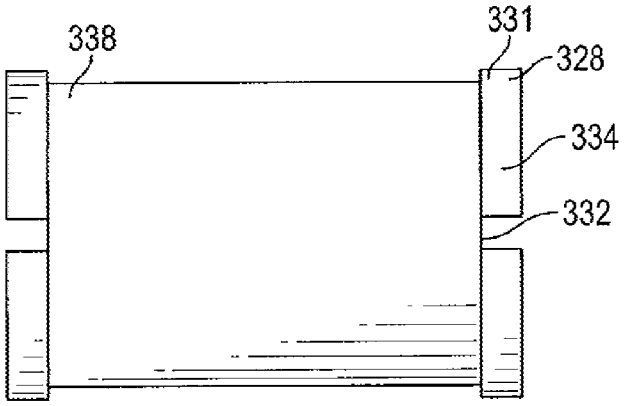
FIG. 3A shows a partial view of the substrate of an exemplary anchoring device for use with a downhole device, such as the downhole device shown in FIG. 2 for use with a downhole system, according to one embodiment of the disclosure.
Figure 3B:
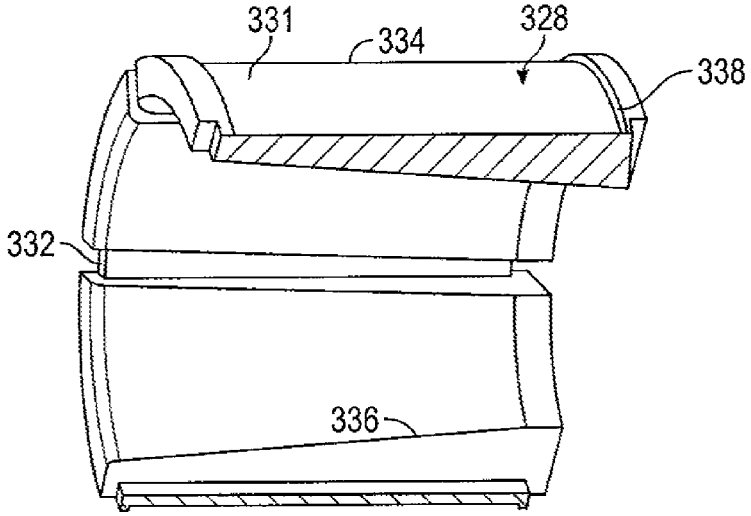
FIG. 3B shows a partial cross sectional view of the anchoring device shown in FIG. 3A.
Figure 3C:
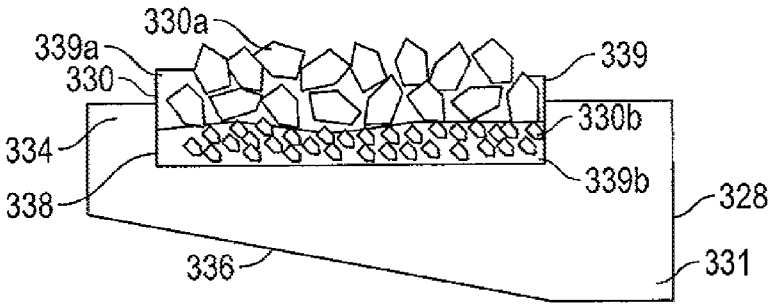
FIG. 3C shows a partial cross sectional view of the anchoring device shown in FIG. 3A with a granular gripping material.

FIGS. 3A, 3B and 3C show an exemplary embodiment of slip ring 328. In an exemplary embodiment, slip ring 328 includes a substrate 331 and a granular gripping material 330. In certain embodiments, slip ring 328 is used with downhole devices as shown in FIG. 2 to anchor the downhole devices against a casing. Advantageously, slip ring 328 is a degradable device, allowing slip ring 328 to degrade without any secondary removal or destruction operations.

In an exemplary embodiment, substrate 331 is a degradable material. Advantageously, by forming substrate 331 of slip ring 328 from a degradable material, a downhole device may be anchored by slip ring 328 for the desired period of time, and then the slip ring 328 may be disintegrated to allow further operations without any obstructions. In certain embodiments, substrate 331 is formed from a corrodible metal such as a controlled electrolytic metallic, including but not limited to Intallic. Substrate 331 materials may include: a magnesium alloy, a magnesium silicon alloy, a magnesium aluminum alloy, a magnesium zinc alloy, a magnesium manganese alloy, a magnesium aluminum zinc alloy, a magnesium aluminum manganese alloy, a magnesium zinc zirconium alloy, and a magnesium rare earth element alloy. Rare earth elements may include, but is not limited to scandium, yttrium, lanthanum, cerium, praseodymium, neodymium, and erbium. In certain embodiments, substrate materials 331 are further coated with aluminum, nickel, iron, tungsten, copper, cobalt. In certain embodiments, substrate 331 materials are consolidated and forged. In certain embodiments, the elements can be formed into a powder and a substrate can be formed from pressed powder. In an exemplary embodiment, the material of substrate 331 is selected based on desired degradation characteristics of slip ring 328.

In an exemplary embodiment, substrate 331 forms a generally cylindrical shape with an inner extent 336 and an outer extent 334. In certain embodiments, inner extent 336 has a reducing or reduced radius portion to allow a downhole device to be retained within the slip ring 328. In an exemplary embodiment, the material of substrate 331 is chosen with respect to the relative hardness of the downhole device to prevent damage to the downhole device. In an exemplary embodiment, outer extent 334 of slip ring 328 is configured to interface with a casing. In an exemplary embodiment, outer extent 334 includes granular gripping material 330 designed to interface with casing.

In an exemplary embodiment, slip ring 328 can be configured to break in to several sections when expanded. In certain embodiments, slip ring 328 can be expanded by a wedge as previously shown in FIG. 2. In order to facilitate fracturing of slip ring 328 certain embodiments of slip ring 328 include crack initiation points 332 disposed on outer extent 334. Crack initiation points 332 include, but are not limited to cuts, grooves, slits, perforations, etc. Crack initiation points 332 may serve as a stress concentration point to initiate cracking, fracturing, or separation along the longitudinal axis of slip ring 328 as slip ring 328 is expanded. In certain embodiments, crack initiation points 332 are formed via electrical discharge machining substrate 331.

In an exemplary embodiment, outer extent 334 includes granular gripping material 330 configured to interface with a casing or other suitable anchor medium. In an exemplary embodiment, the material of granular gripping material 330 is selected to be harder than the interfacing casing. Casing may have a hardness of approximately 120 ksi. Casing grades may range from L80 to Q125. Advantageously, a relatively harder anchor granular gripping material 330 allows for granular gripping material 330 to firmly anchor the downhole device to casing or other suitable anchor medium. In certain embodiments, anchor granular gripping material 330 is formed of a harder material than substrate 331. Advantageously, materials, particularly degradable materials, may not have a suitable hardness to adequately anchor to a casing or other suitable anchor material, requiring the use of a harder anchor granular gripping material 330 as described herein. Materials selected for substrate 331 and granular gripping material 330 may be carefully selected to ensure gripping material 330 embeds further into a casing or anchor medium compared to substrate 331.

In an exemplary embodiment, granular gripping materials 330 are on the outer extent 334 of slip ring 328. In certain embodiments, granular gripping materials 330 are disposed in undercut portion 338. Advantageously, a large portion of slip ring 328 may be covered with granular gripping materials 330 to allow for greater anchoring performance. In certain embodiments, by covering a large portion of slip ring 328 the substrate 331 of slip ring 328 can avoid or mitigate damage. Advantageously, by utilizing granular gripping materials 330, a substrate 331 can be formed with a lower strength material to allow for greater ductility of slip ring 328. In an exemplary embodiment, granular gripping materials 330 can be generally granular form of similar sizes and of regular or irregular shapes. In certain embodiments, granular gripping materials 330*a* can be relatively larger. In other embodiments, granular gripping materials 330*b* can be relatively smaller compared to other granular gripping materials 330*a*. As shown in FIG. 3C the grain size of granular material 330*a*,330*b* may vary based on application. In certain embodiments, granular material 330*a*,330*b* is applied to slip ring 328 in multiple layers. Advantageously, the use of multiple layers of granular material 330*a*,330*b* can prevent damage to substrate 331 by distributing anchor forces and allowing harder materials (or larger granular materials) 330*a* to interface with casing or anchor medium, while softer granular materials (or smaller granular materials) 330*b* interface with substrate 331. In certain embodiments, materials 330*a* interfacing with casing or anchor medium have a granule size of 0.5 to 10 mm. In an embodiment materials 330*a* interfacing with casing or anchor medium have a granule size of 1 to 5 mm. In certain embodiments, materials 330*b* interfacing with substrate 331 have a granule size of 1 micron to 2 mm. In an embodiment, materials 330*b* interfacing with substrate 331 have a granule size of 50 micron to 1 mm. In certain embodiments, the combined thickness of layers 330*a*,330*b* ranges from 0.5 to 10 mm. In an embodiment, the combined thickness of layers 330*a*,330*b* ranges from 2 to 5 mm. Further, the characteristics and performance of slip ring 328 can be adjusted and designed by altering the layers 330*a,b* in relation to substrate 331 and casing or anchor medium. Advantageously, granular gripping materials 330 may be configured to be sized and shaped to allow passage through intended flow paths and to allow operations to continue after a substrate 331 has dissolved.

In an exemplary embodiment, granular gripping materials 330 are formed from disintegrable materials that disintegrate into small particulates. Granular gripping materials 330 can be formed of any suitable material, including, but not limited to oxides, carbides, and nitrides. In certain embodiments, granular gripping materials 330 are formed from aluminum oxide, silicon carbide, tungsten carbide, zirconium dioxide, and silicon nitride. In certain embodiments, granular gripping materials 330 can contain ceramic type proppants or other high hardness materials.

In an exemplary embodiment, granular gripping materials 330 are disposed in an undercut portion 338 formed in substrate 331. In certain embodiments, undercut portion 338 has a smaller outside diameter than the remainder of outer extent 334 to allow the inclusion of granular gripping materials 330 while maintaining the same or similar outside diameter as the remainder of outer extent 334. Advantageously, undercut portion 338 may ease the application of granular gripping material 330 and binder 339.

Granular gripping materials 330 may be attached to substrate 331 via a binder 339 or any other suitable adhesive. In certain embodiments, the binder utilizes is degradable. Binders include, but are not limited to toughened acrylics, epoxy, low metal point metals (such as aluminum, magnesium, zinc, and their alloys), etc. In other embodiments, undercut portion 338 can retain granular gripping materials 330 without any additional components. In certain embodiments, various sizes of granular material 330*a,b* are bound by various binders 339*a,b*. In certain embodiments, various binders 339*a,b* can vary based on size of granular material 330*a,b* as well as relative location within slip ring 328.

Therefore in one aspect, an anchoring device is disclosed, including: a degradable substrate with a first hardness; and a granular gripping material associated with the outer extent of the degradable substrate, wherein the granular gripping material has a second hardness greater than the first hardness. In certain embodiments, the granular gripping material is disintegrable. In certain embodiments, the degradable substrate includes one of: a magnesium alloy, a magnesium silicon alloy, a magnesium aluminum alloy, a magnesium zinc alloy, a magnesium manganese alloy, a magnesium aluminum zinc alloy, a magnesium aluminum manganese alloy, a magnesium zinc zirconium alloy, and a magnesium rare earth element alloy. In certain embodiments, the granular gripping material includes one of: silicon carbide, an oxide, a carbide, a nitride, and a ceramic. In certain embodiments, the granular gripping material is smaller than an intended flow path. In certain embodiments, the degradable substrate includes at least one crack initiation point. In certain embodiments, further including a binder associated with the granular gripping material and the degradable substrate. In certain embodiments, the binder is degradable. In certain embodiments, the granular gripping material includes a plurality of granular layers. In certain embodiments, each granular layer of the plurality of granular layers has a corresponding grain size. In certain embodiments, an innermost granular layer of the plurality of granular layers has a innermost layer hardness or a innermost layer grain size and is adjacent to the degradable substrate, an outermost layer of the plurality of granular layers has a outermost layer hardness or a outermost layer grain size, and the innermost layer grain size is smaller than the outermost layer grain size or the innermost layer hardness is less than the outermost layer hardness.

In another aspect, a method to anchor a downhole device is disclosed, including: providing a degradable substrate with a first hardness; and applying a granular gripping material to the outer extent of the degradable substrate, wherein the granular gripping material has a second hardness greater than the first hardness. In certain embodiments, the granular gripping material is disintegrable. In certain embodiments, the degradable substrate includes one of: a magnesium alloy, a magnesium silicon alloy, a magnesium aluminum alloy, a magnesium zinc alloy, a magnesium manganese alloy, a magnesium aluminum zinc alloy, a magnesium aluminum manganese alloy, a magnesium zinc zirconium alloy, and a magnesium rare earth element alloy. In certain embodiments, the granular gripping material includes one of: silicon carbide, an oxide, a carbide, a nitride, and a ceramic. In certain embodiments, further including a binder associated with the granular gripping material and the degradable substrate. In certain embodiments, the granular gripping material includes a plurality of granular layers. In certain embodiments, an innermost granular layer of the plurality of granular layers has a innermost layer hardness or a innermost layer grain size and is adjacent to the degradable substrate, an outermost layer of the plurality of granular layers has a outermost layer hardness or a outermost layer grain size, and the innermost layer grain size is smaller than the outermost layer grain size or the innermost layer hardness is less than the outermost layer hardness.

In another aspect, a downhole system is disclosed, including: a casing string; and an anchoring device associated with the casing string, including: a degradable substrate with a first hardness; and a granular gripping material associated with the outer extent of the degradable substrate, wherein the granular gripping material has a second hardness greater than the first hardness and the second hardness is greater than a hardness of an inner diameter of the casing string. In certain embodiments, the granular gripping material is disintegrable. In certain embodiments, the anchoring device is associated with a packer or a bridge plug. In certain embodiments, the anchoring device is associated with a wedge.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. An anchoring device, comprising:

a degradable substrate with a first hardness; and a granular gripping material including a plurality of granular layers associated with the outer extent of the degradable substrate, wherein the granular gripping material has a second hardness greater than the first hardness, and wherein the plurality of granular layers includes an innermost granular layer adjacent to the degradable substrate having an innermost layer grain size and an outermost granular layer having an outermost layer grain size, and the innermost layer grain size is smaller than the outermost layer grain size.

2. The anchoring device of claim 1, wherein the granular gripping material is disintegrable.

3. The anchoring device of claim 1, wherein the degradable substrate includes one of: a magnesium alloy, a magnesium silicon alloy, a magnesium aluminum alloy, a magnesium zinc alloy, a magnesium manganese alloy, a magnesium aluminum zinc alloy, a magnesium aluminum manganese alloy, a magnesium zinc zirconium alloy, and a magnesium rare earth element alloy.

4. The anchoring device of claim 1, wherein the granular gripping material includes one of: silicon carbide, an oxide, a carbide, a nitride, and a ceramic.

5. The anchoring device of claim 1, wherein the granular gripping material is smaller than an intended flow path.

6. The anchoring device of claim 1, wherein the degradable substrate includes at least one crack initiation point.

7. The anchoring device of claim 1, further comprising a binder associated with the granular gripping material and the degradable substrate.

8. The anchoring device of claim 7, wherein the binder is degradable.

9. The anchoring device of claim 1, wherein the innermost granular layer has an innermost layer hardness, the outermost layer has an outermost layer hardness, and the innermost layer hardness is less than the outermost layer hardness.

10. A method to anchor a downhole device, comprising:

providing a degradable substrate with a first hardness; and applying a granular gripping material having a plurality of granular layers to the outer extent of the degradable substrate, wherein the granular gripping material has a second hardness greater than the first hardness and wherein the granular gripping material includes an innermost granular layer adjacent to the degradable substrate having an innermost layer grain size and an outermost granular layer having an outermost layer grain size, and the innermost layer grain size is smaller than the outermost layer grain size.

11. The method of claim 10, wherein the granular gripping material is disintegrable.

12. The method of claim 10, wherein the degradable substrate includes one of: a magnesium alloy, a magnesium silicon alloy, a magnesium aluminum alloy, a magnesium zinc alloy, a magnesium manganese alloy, a magnesium aluminum zinc alloy, a magnesium aluminum manganese alloy, a magnesium zinc zirconium alloy, and a magnesium rare earth element alloy.

13. The method of claim 10, wherein the granular gripping material includes one of: silicon carbide, an oxide, a carbide, a nitride, and a ceramic.

14. The method of claim 10, further comprising a binder associated with the granular gripping material and the degradable substrate.

15. The method of claim 10, wherein the innermost granular layer has an innermost layer hardness, the outermost layer has an outermost layer hardness, and the innermost layer hardness is less than the outermost layer hardness.

16. A downhole system, comprising:

a casing string; and an anchoring device associated with the casing string, comprising:

a degradable substrate with a first hardness; and a granular gripping material including a plurality of layers associated with the outer extent of the degradable substrate, wherein the granular gripping material has a second hardness greater than the first hardness and the second hardness is greater than a hardness of an inner diameter of the casing string and wherein the plurality of granular layers includes an innermost granular layer adjacent to the degradable substrate having an innermost layer grain size and an outermost granular layer having an outermost layer grain size, and the innermost layer grain size is smaller than the outermost layer grain size.

17. The system of claim 16, wherein the granular gripping material is disintegrable.

18. The system of claim 16, wherein the anchoring device is associated with a packer or a bridge plug.

19. The system of claim 16, wherein the anchoring device is associated with a wedge.

* * * * *